US005426802A

United States Patent [19]

Greenwood

[11] Patent Number: 5,426,802

[45] Date of Patent: Jun. 27, 1995

[54] SCORING TOOL

[76] Inventor: Delmer Greenwood, 3247 Kathy Way, Loomis, Calif. 95650

[21] Appl. No.: 128,592

[22] Filed: Sep. 28, 1993

[51] Int. Cl.[6] ..... B26B 11/00

[52] U.S. Cl. ..... 7/163; 7/164

[58] Field of Search ..... 7/163, 164, 158

[56] References Cited

U.S. PATENT DOCUMENTS

| | | | |
|---|---|---|---|
| 589,847 | 9/1897 | Miller | 7/164 |
| 2,952,025 | 9/1960 | Johnson | 7/163 |
| 4,910,821 | 3/1990 | Kieferle | 81/488 |

*Primary Examiner*—James G. Smith
*Attorney, Agent, or Firm*—Bielen, Peterson & Lampe

[57] ABSTRACT

A scoring tool for a work piece utilizing a housing. The housing is linked to a scoring element which is capable of extending from the housing to score a work piece for the purpose of marking or cutting the same. A flexible measuring member is included in the present invention and possesses at least one indication of a dimension of the same. The flexible measuring member is capable of lying in the vicinity of the scoring element, preferably in an opening through the housing. The flexible measuring member includes an end portion which terminates in a fence that is capable of confining the end portion of the flexible measuring member to the work piece. Movement of the scoring element along the work piece is easily accomplished since the fence is capable of sliding along the work piece with movement of the scoring member.

6 Claims, 2 Drawing Sheets

FIG-1
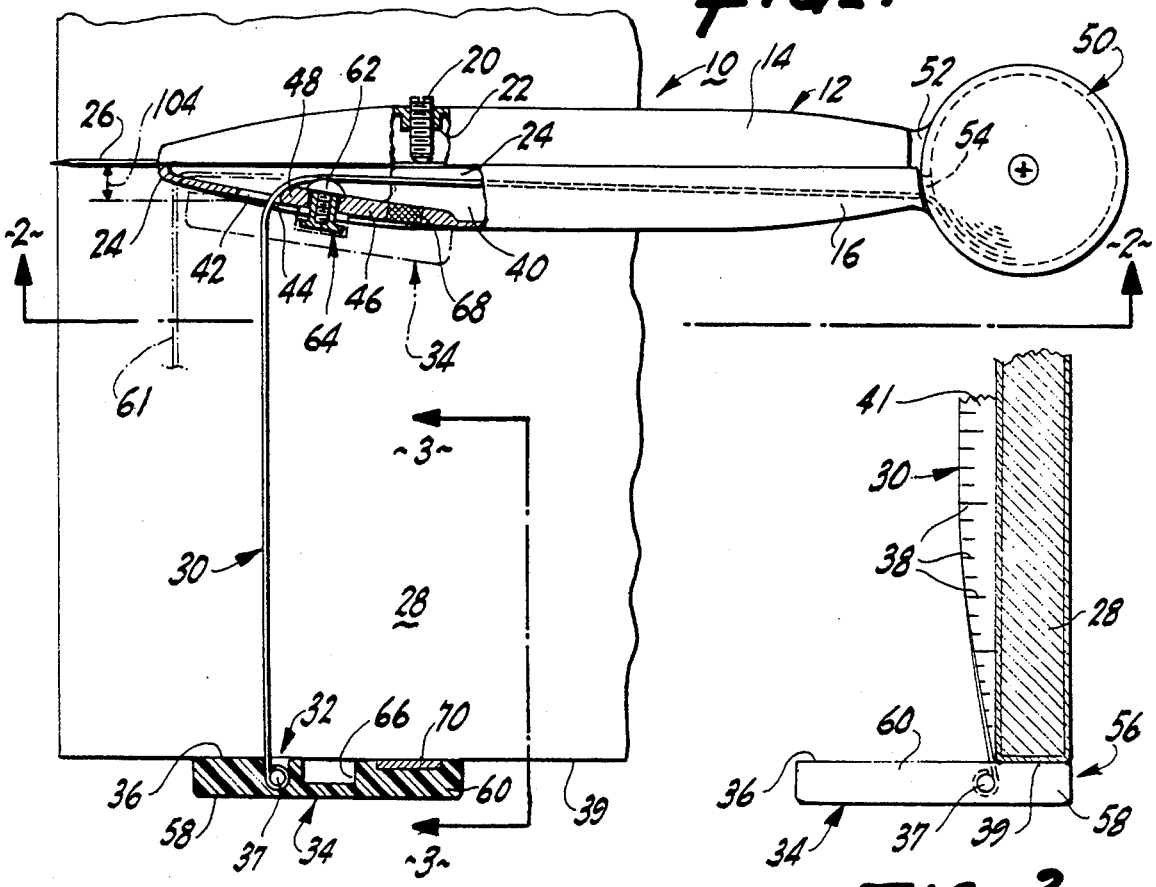
FIG-3
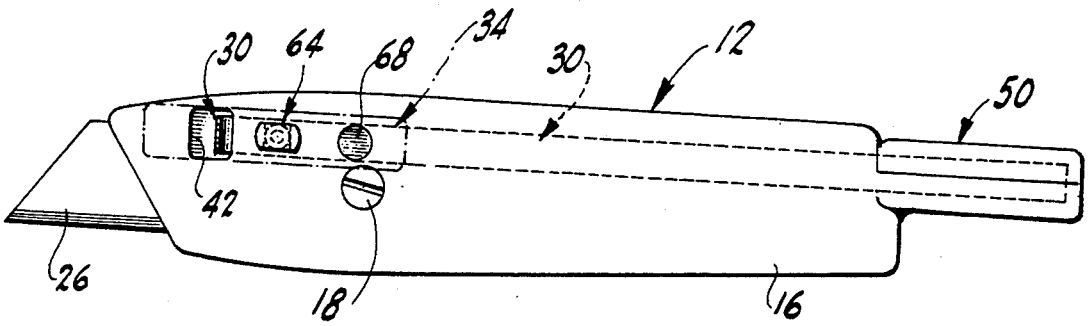
FIG-2

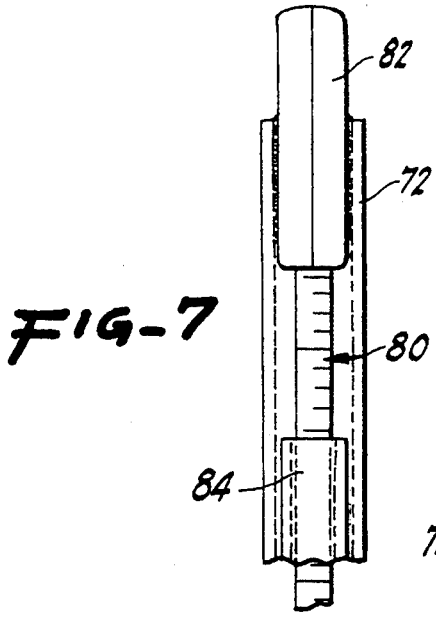
FIG-7
FIG-6
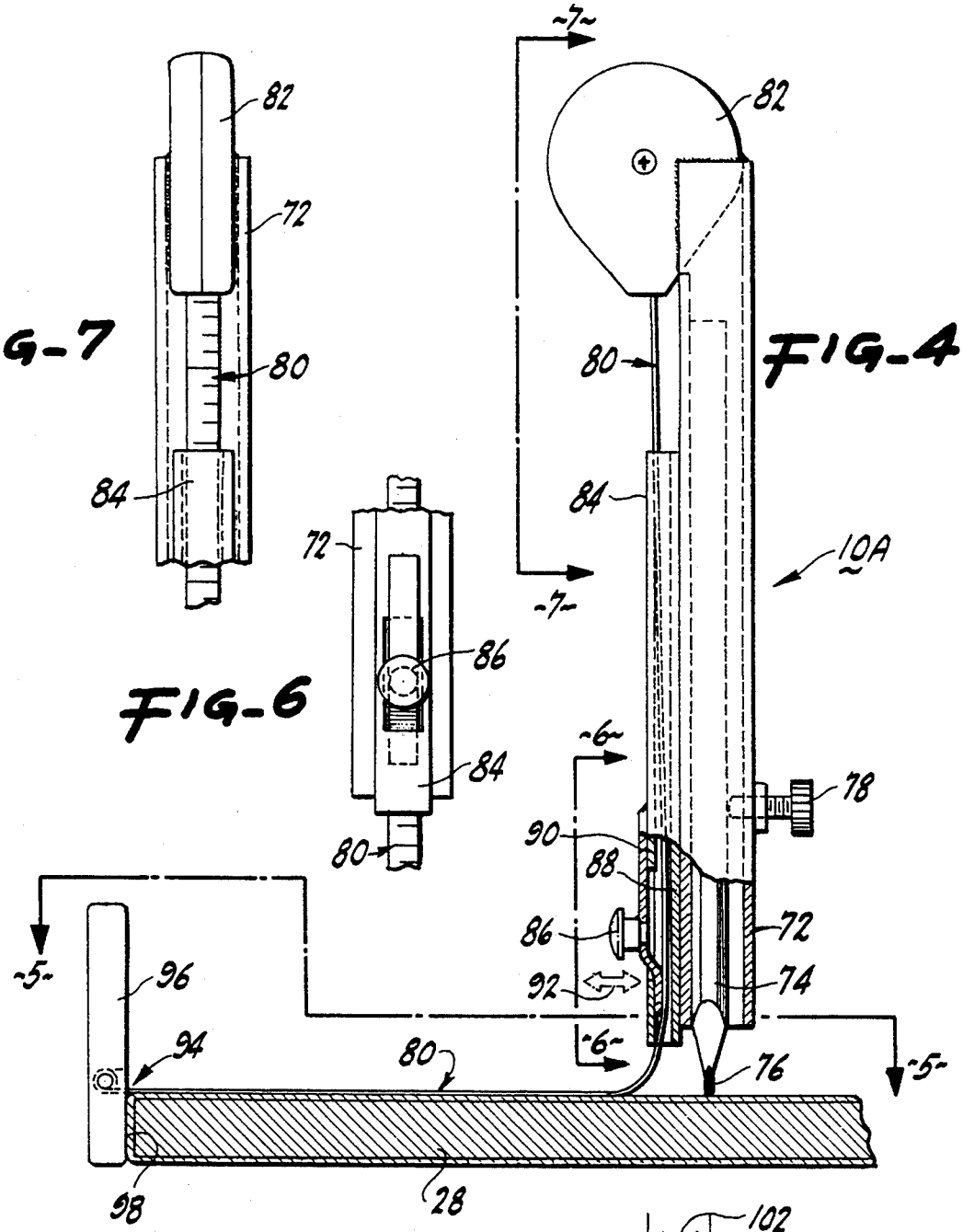
FIG-4
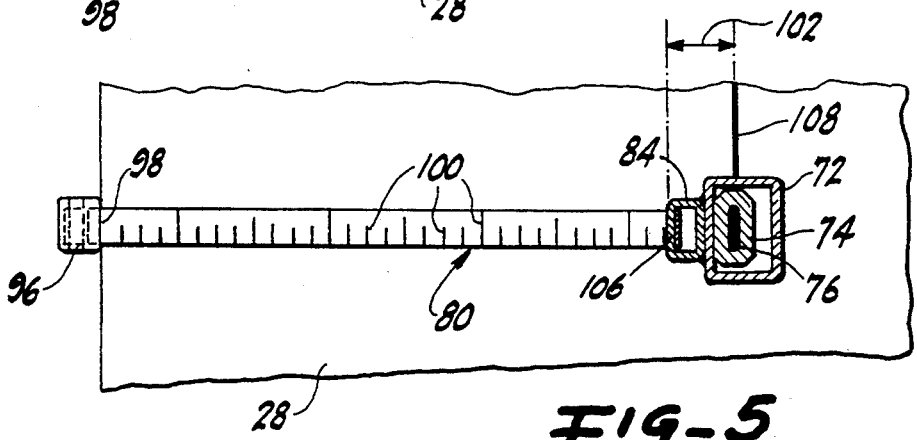
FIG-5

SCORING TOOL

BACKGROUND OF THE INVENTION

The present invention relates to a novel scoring tool which is usable for marking or cutting a work piece.

In the construction arts, it is often necessary for skilled artisans to score a work piece for the purpose of marking the same for cutting or cutting the same during the scoring procedure. For example, gypsum board must be trimmed in many cases with a knife that is run along the board after the separate step of measuring and marking where the cut is to take place. Also, two hands are required to mark sheet material such as plywood for cutting. Normally such marking is accomplished in multiple steps by movement of a measuring tape along the sheet material at a certain distance from an edge. A straight edge is then required to combine such marks into a straight line in order to saw the sheet material along such line.

Although considered a simple task, the marking of materials to be cut or the cutting of materials with a knife is time consuming since such work must be accomplished repetitively.

A tool which simplifies the task of marking and cutting work pieces for the purpose of trimming or sizing would be a notable advance in the construction industry.

SUMMARY OF THE INVENTION

In accordance with the present invention a novel and useful scoring tool for a work piece is herein provided.

The scoring tool of the present invention utilizes a housing which includes an inner chamber capable of holding a cutting blade or a marking device such as a pencil or a pen. The housing also is provided with first and second openings that are separated along the housing body. The scoring element, either in the form of marking or cutting implements, be linked to the end of the housing and near one of the openings of the housing.

A flexible measuring member such as a measuring tape is also included in the present invention. The measuring tape is sized to pass through one of the openings of the housing and exit the opening of the housing near the scoring element. Retraction means may also be included in the present invention and be attached to the housing. Such retraction means may encompass a reel which is capable of coiling and uncoiling the flexible measuring tape. The flexible measuring member, such as a measuring tape, would also be provided with an end portion for extension outwardly from the scoring element linked to the housing.

Holding means is also found in the present invention for confining the end portion of the flexible measuring member to the work piece. The holding means may include a fence permitting the scoring element to score the work piece while the end portion of the member is confined to the work piece, preferably at a straight edge portion. In addition, the holding means may be capable of sliding along the edge piece if a continuous score is to be accomplished on the work piece in the form of a mark or a cut.

Locking means may also be found in the present invention for maintaining an extension of the flexible measuring member end portion at a particular distance from the scoring element linked to the housing. In this regard, the flexible measuring member may have a set of markings which are adjusted in value to compensate for the separation or offset between the scoring element and the point of egress of the flexible measuring member from the housing.

It may be apparent that a novel and useful scoring tool for a work piece has been described.

It is therefore an object of the present invention to provide a scoring tool for a work piece which eliminates separate steps of marking and cutting of sheet material such as gypsum board.

It is another object of the present invention to provide a scoring tool for a work piece which is capable of providing a continuous mark along a work piece without intermittent steps of marking points on a work piece prior to connecting of the same to achieve a continuous line.

It is another object of the present invention to provide a scoring tool for a work piece which is accurate in scoring a work piece and is compact in construction for easy storage and usage of the same.

Another object of the present invention is to provide a scoring tool for a work piece which saves time and, thus, labor in achieving the marking or cutting of pieces of material such as pieces of lumber, sheeting, and the like.

The invention possesses other objects and advantages especially as concerns particular characteristics and features thereof which will become apparent as the specification continues.

BRIEF DESCRIPTION OF THE DRAWINGS

FIG. 1 is a top plan view of the tool of the present invention with the measuring tape portion being extending to a work piece.

FIG. 2 is a sectional view taken along line 2—2 of FIG. 1.

FIG. 3 is a sectional view taken along line 3—3 of FIG. 1.

FIG. 4 is a top plan view of another embodiment of the invention with a portion shown in section.

FIG. 5 is a sectional view taken along line 5—5 of FIG. 4.

FIG. 6 is a side view taken along line 6—6 of FIG. 4.

FIG. 7 is a side view taken along line 7—7 of FIG. 4.

For a better understanding of the invention references made to the following detailed description of the preferred embodiments thereof which should be referenced to the prior described drawings.

DETAILED DESCRIPTION OF THE PREFERRED EMBODIMENTS

Various aspects of the present invention will evolve from the following detailed description of the preferred embodiment thereof which should be taken in conjunction with the prior described drawings.

The invention as a whole is depicted in the drawings by reference character 10. The scoring tool 10 includes as one of its elements a housing 12, FIG. 1. Housing 12 may be formed as a pair of curved portions 14 and 16 which are held together by a threaded set screw 18 which threadingly engages openings in walls 22 and 24 of portions 14 and 16 of housing 12. In addition, a scoring element 26 in the form of a knife is held within housing 12 by set screw 20. Set screw 20 engages knife 26 in this regard, FIG. 1. As heretofore described, housing 12, knife scoring element 26, and set screw 18 are of conventional configuration such as a panel knife sold by Stanley Tool Co. STANLEY, Model No. 10-299. It should be noted that scoring element 26 is, thus, linked to housing 12 and extends therefrom for use in cutting or marking the work piece 28, which may be a sheet or a length of material, such as lumber, gypsum board, plywood, and the like.

Scoring tool 10 is also provided with a flexible measuring member 30 which is in the form of a measuring tape. Tape 30 includes a series of marks 38 which correspond to the length of the same. Member 30 terminates in an end portion 32 having fence 34 which rotates about pivot pin 37. Fence 34 includes a flat surface 36 intended to contact a surface 39 of work piece 28. With reference to FIG. 3, it may be seen that plurality of markings 38 are imprinted on surface 41 of tape 30 to indicate the distance between surface 36 and the length of tape 30 extending from surface 36. Tape 30 extends to the interior 40 of housing 12 through opening 42. Meeting place 44 of tape 30 and wall 24 of housing 12 would be indicated by a particular marking of plurality of markings 38 on tape surface 39. Structural member 46, fixed to housing 12 includes a rounded edge 48 which serves to bend tape 30 at approximately 90 degrees as depicted in FIG. 1. Tape 30 passes above set screw 18 and into a retractable portion 50 which is in the form of a spring loaded reel of conventional configuration. Reel 50 is connected to housing 12 at neck 52 by welding, gluing, or any fastening means. Tape 30 passes to the interior 40 of housing 12 through an opening 54 adjacent reel 50. Thus, tape 30 is free to move through the interior 40 of housing 12 without interference from set screw 18 or scoring element 26.

Fence 34 serves as holding means 56, FIG. 3 to permit scoring element 26 to score work piece 28 while fence 34 is confined to work piece 28. It should be noted that small portion 58 of fence 34 is intended for contacting work piece 28 at surface 36, while long portion 61 of fence 34 is intended to be grasped by the user. Moreover, tape 30 may exit the interior 40 of housing 12 as indicated by tape 60 (dashed line on FIG. 1) or any other convenient position adjacent scoring element 26.

Moveable button 62 serves as locking means 64 for maintaining the extension of tape 30 a certain distance from scoring element 26. Button 62 is moveable inwardly and outwardly through structural member 46. Recess 66 and fence 34 permit the snug mating of fence 34 with the exterior of housing 12. In addition, magnet 68, FIGS. 1 and 2, attracts metallic strip 70 in fence 34 to hold fence 34 in snug a position against wall 16 of housing 12. The positioning of fence 34 against wall 16 is depicted and phantom on FIG. 1.

Turning now to FIG. 4, it should be noted that another embodiment 10A of the scoring tool of the present invention is depicted. Scoring tool 10A includes a compartment 72 containing a marking tool 74 such as a pencil. Set screw 78 threadingly engages compartment 72 and holds marking tool 74 such that the marking portion 76 thereof extends a desired distance from compartment 72. A measuring tape 80 extends out of or retracts into a reel 82 in the same manner with respect to reel 50 of FIG. 1. Measuring tape 80 passes through a compartment 84, which is integrally formed with compartment 72 or affixed thereto by any suitable means. Compartment 84 permits the passage of measuring tape therethrough. Button 86 is capable of holding tape 80 to inner wall 88 by movement through wall 90 of compartment 84, directional arrow 92.

End portion 94 of measuring tape 80 includes a pivoting fence 96 having a flat surface 98 which contacts work piece 28 as depicted in FIG. 4. As with measuring tape 30, measuring tape 80 includes a plurality of markings 100. An offset distance 102, FIG. 5, corresponds to the offset distance 104, FIG. 1, with respect to the embodiment 10 therein depicted. Such offset distance 104 must be added to the measurement found at meeting place 44, FIG. 1. Offset distance 102 would be added to the distance indicated by tape 80 at wall 106 of compartment 84, FIG. 5 to obtain the true distance of scoring element 26 from surface 36.

In operation, the user trimming work piece 28 would either employ embodiment 10 or 10A depending on the type material, where work piece 28 is relatively soft, embodiment 10 would be used such that fence 34 is placed at the edge of work piece 28 as depicted in FIG. 3. Tape 30 is then unwound from reel 50 through housing 12 until a proper measurement is indicated at meeting place 44. Of course, offset distance 104 would be added to this to obtain a true distance measurement and the proper place where knife 26 is to meet work piece 28. Surface 36 of fence 34 would permit sliding of the same relative to work piece 28 such that knife 26 may be run along work piece 28 to cut the same in a straight line. Where work piece 28 includes material which is relative hard, scoring tool embodiment 10A would be employed in the same manner. That is, pivoting fence would be aligned along flat surface 98 of work piece 28 and measuring tape 80 would extend from reel 82 the requisite distance indicated at wall 106 of compartment 84, FIG. 5. Offset distance 102 would be added which represents the distance from wall 106 to the center line of score mark 108 produced by marking portion 76 of marking tool 74. Again, fence 96 in marking tool 74 would be run along work piece 28 to produce a straight line at a certain distance from surface 98. A saw or other cutting implement would then be used to cut work piece 28 in this instance.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A scoring tool for a work piece, comprising:

a. a housing, said housing including a first end portion, a second end portion, and a compartment within said housing between said first and second end portions, said housing compartment further including a first opening and a second opening;

b. a scoring element, said scoring element being linked to said housing at said housing second end portion and being capable of extending from said housing, said scoring element being further capable of extending into said housing compartment a certain distance;

c. a flexible measuring member, said flexible measuring member including at least one indication of a dimension of said flexible measuring member, said flexible measuring member being capable of extending from and retracting to a retractable portion through said housing compartment first opening, said retractable portion being fixed to the housing, said flexible measuring member possessing an end portion being capable of extending alongside said scoring element within said housing compartment and exiting said compartment second opening no further than said certain distance of extention of said scoring element into said housing compartment; and d. holding means for confining said end portion of said member to a work piece, said holding means permitting said scoring element to score the work piece during said confinement of said end portion of said flexible measuring member extending from said second opening of said housing compartment.

2. The scoring tool of claim 1 which further includes locking means for maintaining an extension of said flexible measuring member from said scoring element.

3. The scoring tool of claim 1 in which said holding means includes said end portion of said member possessing a surface slidable relative to the work piece.

4. The scoring tool of claim 1 in which said housing compartment further comprises an edge portion capable of bearing on said flexible measuring member to bend said flexible measuring means when said flexible measuring member is extended outwardly from said scoring tool.

5. The scoring tool of claim 1 in which said scoring element is a cutting implement.

6. The scoring tool of claim 1 in which said scoring element is a marking implement.

* * * * *